US005984492A

United States Patent [19]

Cha

[11] Patent Number: 5,984,492

[45] Date of Patent: Nov. 16, 1999

[54] MORPHING LAMP

[75] Inventor: Michael Joon Cha, New York, N.Y.

[73] Assignee: New Paradigm Corp., River Edge, N.J.

[21] Appl. No.: 08/924,516

[22] Filed: Sep. 5, 1997

[51] Int. Cl.[6] ..... F21V 1/10

[52] U.S. Cl. ..... 362/278; 362/35; 362/320; 40/431

[58] Field of Search ..... 362/35, 278, 284, 362/324, 358, 355, 806, 811, 320; 40/431

[56] References Cited

U.S. PATENT DOCUMENTS 4,173,038 10/1979 Kiefer ..... 362/35

4,736,278 4/1988 Wolens et al. ..... 362/35

5,513,084 4/1996 Simpson ..... 362/284

*Primary Examiner*—Stephen Husar

[57] ABSTRACT

This invention is in the field of novelty lighting and aesthetic display device, with a unique shape changing ability. With the use of an elastic outer membrane and an array of rotating rod frames, the Morphing Lamp constantly changes its volumetric shape, which presents a unique visual effect. The light source inside the membrane illuminates the outer membranes, which enhances the presentation of the volumetric shape. The light permeating through the translucent outer membrane is a source of soft lighting.

1 Claim, 2 Drawing Sheets

MORPHING LAMP

BACKGROUND OF THE INVENTION

1. Field of the Invention

This invention relates to a novelty lamp that is visually unique, as well as a source of light. With the use of an electrical motor, the Morphing Lamp changes its volumetric shape.

2. Description of the Related Art Including Information Disclosed Under 37 CFR 1.97 and 1.98

After a patent search, no prior art device could be found. There were other lighting devices that had elements of rotation like U.S. Pat. No. 4,173,038 to Sun et. al. And U.S. Pat. No. 4,736,278 to Wolens et. al., but they did not relate to the unique shape changing quality of the Morphing Lamp.

BRIEF SUMMARY OF THE INVENTION

The Morphing Lamp is a novelty lighting and display device, with a unique shape changing ability. With the use of an elastic outer membrane that surrounds a rotating frame, the Morphing Lamp constantly changes its volumetric shape, which presents a unique visual effect. The light source inside the membrane illuminates the outer membrane, enhancing the presentation of the volumetric shape. The light permeating through the translucent outer membrane is a source of soft lighting.

This lamp presents a unique morphing effect, that is aesthetically pleasing. The morphing quality is further enhanced with the illumination of the elastic outer membrane. The Morphing Lamp also acts as a lighting fixture, radiating soft lights.

BRIEF DESCRIPTION OF THE SEVERAL VIEWS OF THE DRAWING(S)

DETAILED DESCRIPTION OF THE INVENTION

Figure 1:
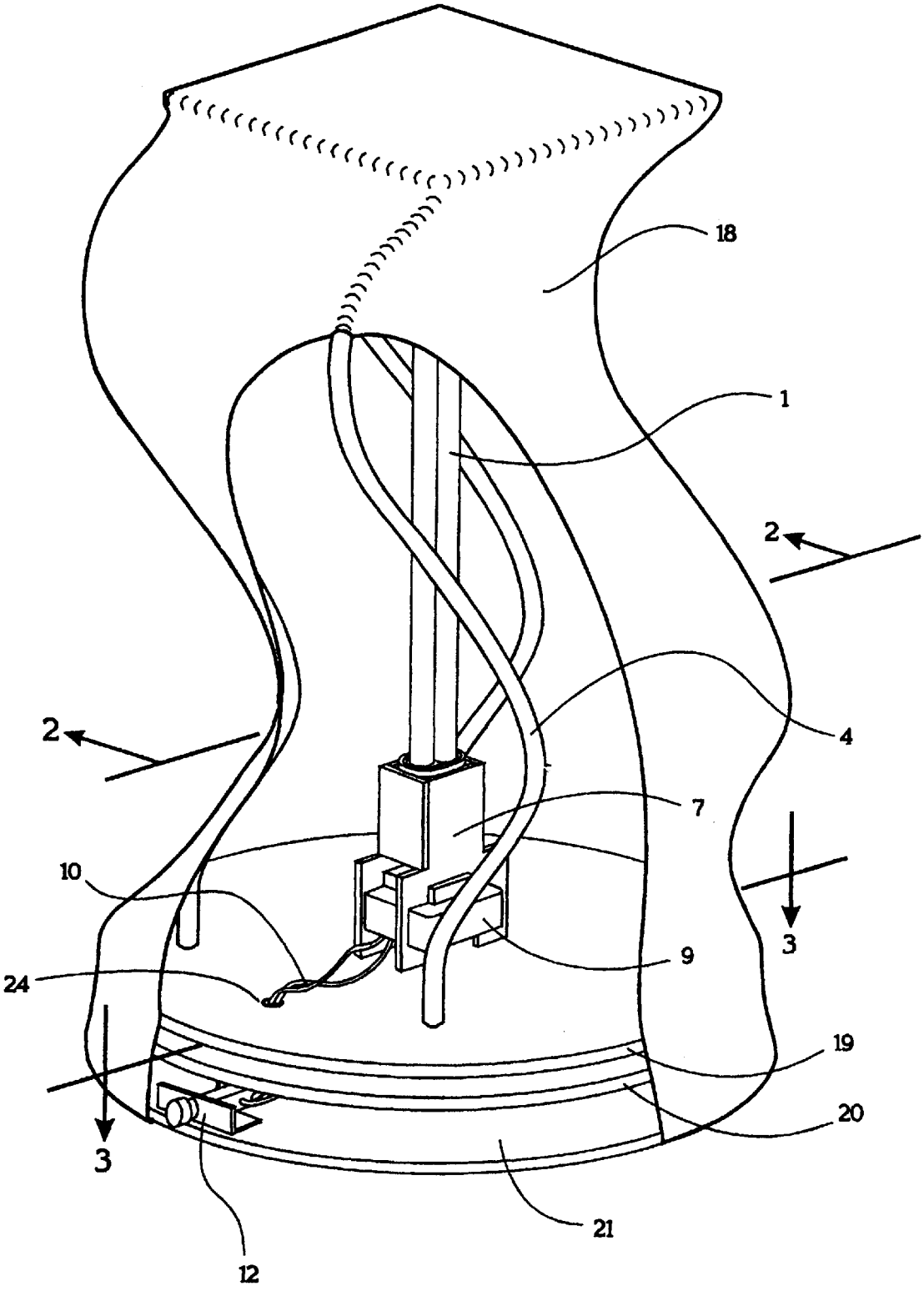
FIG. 1 is a perspective view of the Morphing Lamp. The view is illustrated with a partial cut out of the outer elastic membrane to show the inner structures.

In FIG. 1, the locking push-in electrical switch (12) is located mounted to the bottom plate (21) with small screws. The elastic outer membrane (18) covers the top and the sides of the lamp. The push-in button of the electrical switch creates a small bulge on the outer membrane.

Figure 2:
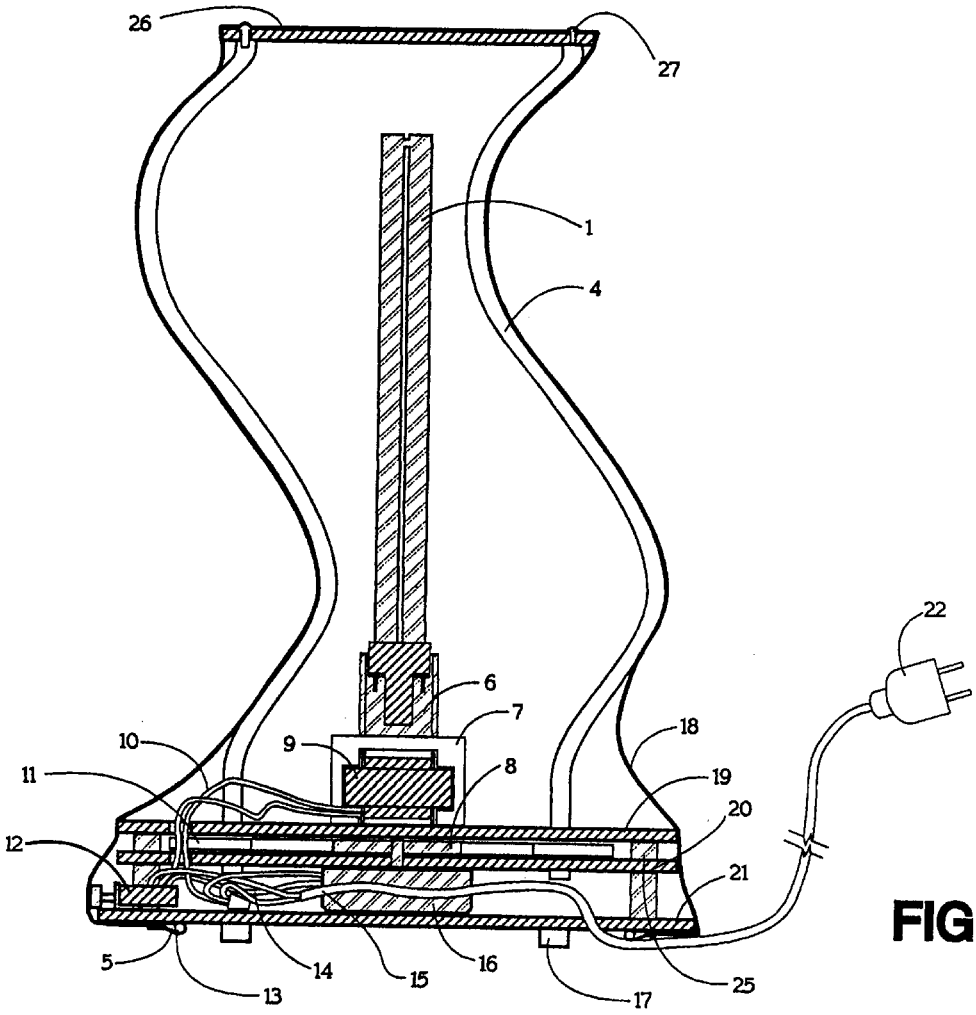
FIG. 2 is an elevation cross section view of the Morphing Lamp. The cut of the elevation cross section runs along lines 2—2 in FIG. 1.

In FIG. 2, the power plug (22) connects to any standard electric socket. The power supply wire (15) which is connected to the power plug, enters the lamp through a hole cut in the bottom plate (21). One lead of the power line connects to the push-in switch (12). The other lead connects to the low speed motor (16), and the florescent light fixture. The florescent light fixture is comprised of a long plug-in type florescent bulb (1) and the ballast (9).

In FIG. 2, the receptacle for the plug in bulb (6) holds the florescent bulb in place. The receptacle and the ballast (9) are held in place by a plastic frame (7), which is mounted on to the top plate (19). The florescent light fixture and the ballast will be mounted in the middle of the top plate.

In FIG. 2, the wires (10) leading out of the ballast and florescent bulb passes through hole (24), which is cut through the top (19) and the middle (20) plates. The wires (10) are connected to the power supply wire (15) and the push-in switch (12).

In FIG. 1, the four S-Shaped metal rods (4) are wrapped by a removable, and exchangeable elastic tube membrane (18) that extends all the way down to the base of the lamp. The membrane is made of smooth stretchable fabric, such as Lycra and/or nylon. Other materials and blends are possible, as to provide the desired elasticity and translucency. The fabric is tightly woven enough so as not to run or deform from the continuos contact with the metal rods. The membrane is in a tube form, and does not have a seam. The tube is sewn closed on the top to match the square shape of the top square plate (26). The membrane tapers out at the bottom to fit the larger diameter of the top plate (19), middle plate (20), and bottom plate (21). The open end of the membrane is folded over and sewn, as to create a small seam, where an elastic band (13) is placed in it. When the elastic membrane is installed over the lamp body, it stretches over the bottom plate, where the elastic band prevents the membrane from riding upward. Protruding hooks (5) formed from the base plate hold the elastic band in place, creating enough tension on the elastic outer membrane as not to wrinkle or bunch.

In FIG. 2, a slow speed motor (16) is used. This motor will have any necessary reduction gears necessary to produce a slow revolution. The motor will also have an automatic reverse rotation capability, in the case of excessive strain on the motor due to an unforeseen obstruction. The slow speed motor (16) is mounted onto the center of the middle plate (20).

Figure 3:
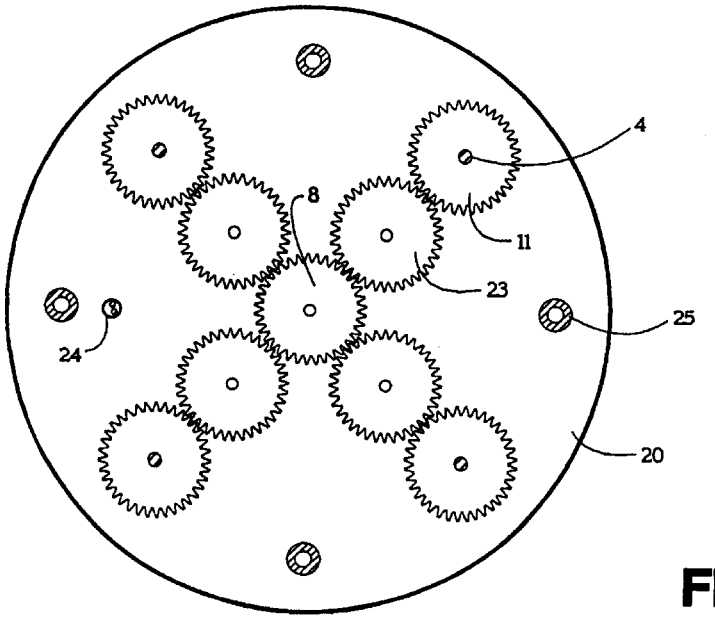
FIG. 3 is a plan cross section view of the Morphing Lamp. The cut of the plan cross section runs along lines 3—3 in FIG. 1.

In FIG. 3, the main gear (8) is directly connected to the drive shaft of the motor. When the Morphing Lamp is turned on, the motor turns the main gear. This then turns the four middle transfer gears (23). The middle transfer gears then turn the four outer gears (11). The outer gears (11) are connected to the s-shaped metal rods. The turning of the metal rods produce the morphing effect.

In FIG. 2, the gears are all sandwiched in between the top (19) and middle plate (20). Spacers (25) are placed in between the plates. This assembly is held in place with screws.

In FIG. 2, rubber stoppers 17 are attached to the lower surface of the bottom plate (21) with small screws or adhesives. The stoppers elevate the base of the bottom plate (21) enough to let the power supply wire pass without obstruction. It also provides a non-slip surface for the Morphing Lamp.

In FIG. 2, the top of the four metal rods are attached to a top square plate (26), with screws with smooth heads on top (27). The head of the screws are smooth as to prevent snagging of the outer elastic membrane. The screws are screwed into the top ends of the metal rods. The side of the top ends of the metal rod are crimped as to prevent the screws from becoming loose. The screws are attached loosely to the square top plate, as to provide easy rotation of the metal rods around them.

I claim:

1. A unique lighting device with a volumetric shape changing ability comprising:

a. shaped rods which turn and act as framework for an elastic outer membrane;

b. said elastic outer membrane disposed over said framework, defining the volume to the lamp;

c. a low speed motor which with the use of rotary transmission means turn the said shaped rods;

d. a light source that illuminates the said elastic outer membrane from the inside, creating a glowing effect as well as a source of light;

e. and a means for supplying electric current to at least one of said low speed motor and said light source.

* * * * *